US011315455B1

(12) United States Patent
Liu et al.

(10) Patent No.: US 11,315,455 B1
(45) Date of Patent: Apr. 26, 2022

(54) DISPLAY PANEL, METHOD FOR DETECTING STRESS-DETECTION-MISS THEREOF, AND DISPLAY DEVICE

(71) Applicant: Xiamen Tianma Micro-Electronics Co., Ltd., Xiamen (CN)

(72) Inventors: Liyuan Liu, Shanghai (CN); Mengmeng Zhang, Shanghai (CN); Zhengxia Lu, Shanghai (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 17/324,559

(22) Filed: May 19, 2021

(30) Foreign Application Priority Data

Feb. 19, 2021 (CN) ..... 202110188770.3

(51) Int. Cl.
*G09G 3/00* (2006.01)
*G09G 3/3258* (2016.01)

(52) U.S. Cl.
CPC ..... *G09G 3/006* (2013.01); *G09G 3/3258* (2013.01); *G09G 2300/0413* (2013.01); *G09G 2330/021* (2013.01)

(58) Field of Classification Search
CPC ..... G09G 3/006; G09G 3/3258; G09G 2300/0413; G09G 2330/021
USPC ..... 345/211
See application file for complete search history.

(56) References Cited

U.S. PATENT DOCUMENTS 7,911,217 B2 * 3/2011 Nam ..... G09G 3/3696 324/760.01
2010/0103184 A1 * 4/2010 Chen ..... G09G 3/006 345/559
2016/0253966 A1 * 9/2016 Xie ..... G09G 3/3225 345/213
2017/0011691 A1 * 1/2017 Mamba ..... G09G 3/3677
2020/0168154 A1 * 5/2020 Cheng ..... H01L 27/1255

FOREIGN PATENT DOCUMENTS

CN 101449202 A 6/2009

* cited by examiner

*Primary Examiner* — Tom V Sheng
(74) *Attorney, Agent, or Firm* — Anova Law Group, PLLC

(57) ABSTRACT

The present disclosure provides a display panel, including: a display driving circuit; power signal lines connected to the display driving circuit; an external stress detection terminal; and a stress-detection-miss detection circuit, that first access ports of the external stress detection terminal are one-to-one connected to the power signal lines; a second access port of the external stress detection terminal is connected to the stress-detection-miss detection circuit; any one of the power signal lines transmits a power supply voltage during normal display of the display panel, and transmits a first high-voltage detection voltage from the first access ports during a stress image detection of the display panel; and the stress-detection-miss detection circuit includes: a prompt information path formed responding to a second high-voltage detection voltage from the second access port during the stress image detection, to generate prompt information responding to a low-voltage detection voltage from the second access port during a stress-detection-miss detection of the display panel.

20 Claims, 18 Drawing Sheets

DISPLAY PANEL, METHOD FOR DETECTING STRESS-DETECTION-MISS THEREOF, AND DISPLAY DEVICE

CROSS-REFERENCE TO RELATED APPLICATION

This application claims the priority of Chinese Patent Application No. CN202110188770.3, filed on Feb. 19, 2021, the entire contents of all of which are incorporated herein by reference.

FIELD OF THE DISCLOSURE

The present disclosure generally relates to the field of display technologies and, in particular, relates to a display panel, a method for detecting stress-detection-miss thereof, and a display device.

BACKGROUND

With continuous development of display technologies, consumers' requirements for display panels continue to increase. Various types of displays have emerged and developed rapidly, such as liquid crystal display panels, organic light-emitting display panels, and other displays. On this basis, display technologies such as three-dimensional (3D) display, touch display technology, curved display, ultra-high resolution display, and anti-peep display are emerging to meet needs of the consumers. The organic light-emitting display panels have gradually become mainstream products in the display industry nowadays due to their advantages of lightness and thinness, high contrast, and achievable curved design, and have attracted widespread popularity among the consumers. Before an organic light-emitting display panel leaves a factory, a stress image detection is generally performed to improve a flickering problem of the display panel. However, existing display panels may experience stress-detection-miss, which causes the flickering problem of the display panels to be serious, making display effect of the display panels poor.

BRIEF SUMMARY OF THE DISCLOSURE

One aspect of the present disclosure provides a display panel, including: a display driving circuit; a plurality of power signal lines connected to the display driving circuit; an external stress detection terminal; and a stress-detection-miss detection circuit, that first access ports of the external stress detection terminal are connected to the plurality of power signal lines in a one-to-one correspondence; a second access port of the external stress detection terminal is connected to the stress-detection-miss detection circuit; any one of the plurality of power signal lines is configured to transmit a power supply voltage during normal display of the display panel, and to transmit a first high-voltage detection voltage input from the first access ports during a stress image detection of the display panel, that an absolute value of the first high-voltage detection voltage is greater than an absolute value of the power supply voltage; and the stress-detection-miss detection circuit includes: a prompt information path formed in response to a second high-voltage detection voltage input from the second access port during the stress image detection of the display panel, that the stress-detection-miss detection circuit is configured to generate prompt information through the prompt information path in response to a low-voltage detection voltage input from the second access port during a stress-detection-miss detection of the display panel, that an absolute value of the second high-voltage detection voltage is greater than an absolute value of the low-voltage detection voltage.

Another aspect of the present disclosure provides a method for detecting stress-detection-miss of the disclosed display panel, including: inputting the low-voltage detection voltage to the second access port of the external stress detection terminal, and in response to a determination that the stress-detection-miss detection circuit does not generate the prompt information based on the low-voltage detection voltage, determining that the display panel has the stress-detection-miss.

Another aspect of the present disclosure provides a display device, including: a display panel, including: a display driving circuit; a plurality of power signal lines connected to the display driving circuit; an external stress detection terminal; and a stress-detection-miss detection circuit, that first access ports of the external stress detection terminal are connected to the plurality of power signal lines in a one-to-one correspondence; a second access port of the external stress detection terminal is connected to the stress-detection-miss detection circuit; any one of the plurality of power signal lines is configured to transmit a power supply voltage during normal display of the display panel, and to transmit a first high-voltage detection voltage input from the first access ports during a stress image detection of the display panel, that an absolute value of the first high-voltage detection voltage is greater than an absolute value of the power supply voltage; and the stress-detection-miss detection circuit includes: a prompt information path formed in response to a second high-voltage detection voltage input from the second access port during the stress image detection of the display panel, that the stress-detection-miss detection circuit is configured to generate prompt information through the prompt information path in response to a low-voltage detection voltage input from the second access port during a stress-detection-miss detection of the display panel, that an absolute value of the second high-voltage detection voltage is greater than an absolute value of the low-voltage detection voltage.

Other aspects of the present disclosure can be understood by those skilled in the art in light of the description, the claims, and the drawings of the present disclosure.

BRIEF DESCRIPTION OF THE DRAWINGS

To more clearly illustrate the technical solutions of the present disclosure, the accompanying drawings used in the description of the disclosed embodiments are briefly described hereinafter. The following drawings are merely examples for illustrative purposes according to various disclosed embodiments and are not intended to limit the scope of the present disclosure. Other drawings may be derived from such drawings by a person with ordinary skill in the art without creative efforts.

DETAILED DESCRIPTION

Figure 1:
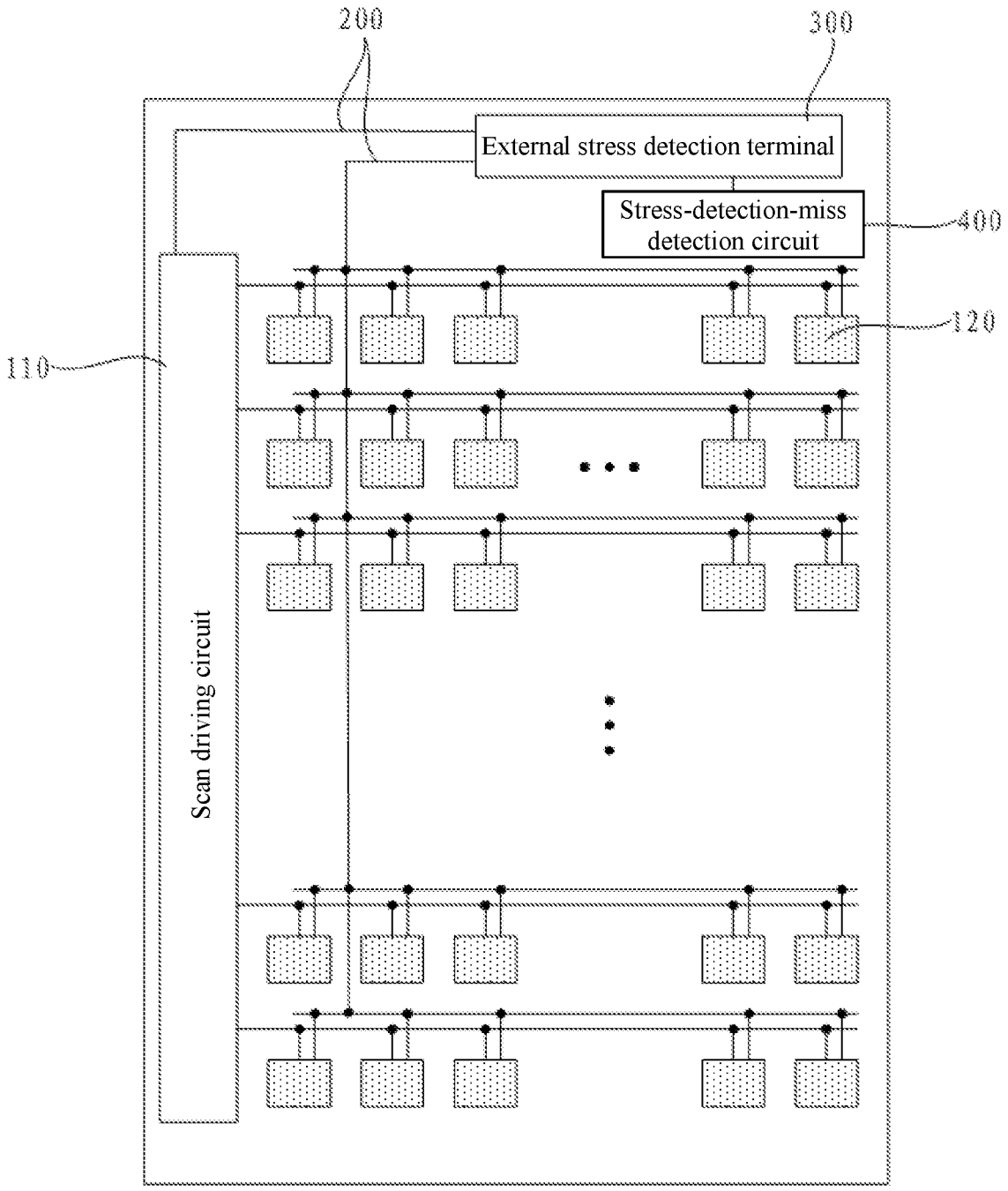
FIG. 1 is a schematic structural diagram of an exemplary display panel according to various embodiments of the present disclosure.

The technical solutions in the embodiments of the present disclosure will be described clearly and completely in conjunction with the accompanying drawings in the embodiments of the present disclosure. The described embodiments are only a part of the embodiments of the present disclosure, rather than all the embodiments. Based on the embodiments of the present disclosure, all other embodiments obtained by those of ordinary skill in the art without creative work shall fall within the protection scope of the present disclosure.

Organic light-emitting display panels have gradually become mainstream products due to their advantages of lightness and thinness, high contrast, and achievable curved design, and have attracted widespread popularity among the consumers. Before an organic light-emitting display panel leaves a factory, a stress image detection is generally performed to improve the flickering problem of the display panel. For example, in a stress image detection, an image corresponding to a high voltage that exceeds a highest value of a normal/regular lighting voltage range and/or an image corresponding to a low voltage that exceeds a lowest value of the normal/regular lighting voltage range may be used to light up the display panel to improve the flickering problem.

The stress image detection provides a high-voltage detection voltage to power signal lines connected to a display driving circuit of the display panel. An absolute value of the high-voltage detection voltage is greater than an absolute value of a power supply voltage transmitted by the power signal lines during normal display of the display panel, such as an anode high-voltage detection voltage provided to a PVDD signal line, a cathode high-voltage detection voltage provided to a PVEE signal line, a high-level high-voltage detection voltage provided to a VGH signal line, a low-level high-voltage detection voltage provided to a VGL signal line, a reference high-voltage detection voltage provided to a Vref signal line, etc. These high-voltage detection voltages are directly or indirectly transmitted to pixel circuits in the display driving circuit, to perform high-voltage repair for functional transistors connected to gates of driving transistors in the pixel circuits, thereby improving stability of voltages at the gates of the driving transistors, and improving the flickering problem that occurs during display of the display panel. However, existing display panels have stress-detection-miss, which cannot be found, and materials are wasted when entering subsequent processes. After the subsequent processes, the display panels cannot be reworked, thereby resulting in a decline in yield. On another hand, the flickering problem of the display panels is serious, which makes the display effect of the display panels poor.

Various embodiments of the present disclosure provide a display panel, a method for detecting stress-detection-miss, and a display device, which effectively solve the technical problems existing in the existing technologies. In one embodiment, whether the display panel has passed a stress image detection (also referred to as "stress detection") can be determined by determining whether a stress-detection-miss detection circuit generates prompt information in response to a low-voltage detection voltage (or a normal-voltage detection voltage), thereby avoiding the stress-detection-miss of the display panel, and ensuring that the display panel has high display effect.

To achieve the foregoing objectives, the technical solutions provided by the embodiments of the present disclosure are as follows. The technical solutions provided by the embodiments of the present disclosure will be described in detail with reference to FIGS. 1 to 16.

Referring to FIG. 1, a schematic structural diagram of an exemplary display panel according to various embodiments of the present disclosure.

The display panel includes a display driving circuit. The display driving circuit includes a scan driving circuit 110 and an array of pixel circuits 120 connected to the scan driving circuit 110. The scan driving circuit 110 is configured to provide scan driving signals row by row to the pixel circuits 120 of each row, and to scan the pixel circuits 120 and control the pixel circuits 120 to light up light-emitting devices of the pixel circuits 120.

A plurality of power signal lines 200 is connected to the display driving circuit. The plurality of power signal lines 200 may include at least one power signal line 200 electrically connected to the scan driving circuit 110. For example, the power signal line can be a high-level VGH signal line that provides a high-level voltage during the normal display of the display panel, a low-level VGL signal line that provides a low-level voltage during the normal display of the display panel, etc. The plurality of power signal lines 200 may also include at least one power signal line electrically connected to the pixel circuits 120. For example, the power signal line can be an anode PVDD signal line that provides an anode voltage during the normal display of the display panel, a cathode PVEE signal line that provides a cathode voltage during the normal display of the display panel, a reference Vref signal line that provides a reference voltage during the normal display of the display panel, etc. A power supply voltage transmitted by any one power signal line can be the high-level voltage, the low-level voltage, the anode voltage, the cathode voltage, the reference voltage, and so on.

The display panel also includes an external stress detection terminal 300 and a stress-detection-miss detection circuit 400. A plurality of first access ports of the external stress detection terminal 300 is connected to the plurality of power signal lines 200 in a one-to-one correspondence. The external stress detection terminal 300 includes the plurality of first access ports, each of the plurality of first access ports is correspondingly connected to a power signal line 200, and corresponding different first high-voltage detection voltages are provided to different power signal lines 200 through different first access ports. A second access port of the external stress detection terminal 300 is connected to the stress-detection-miss detection circuit 400.

In the embodiments of the present disclosure, any one of the plurality of power signal lines 200 provided by the present disclosure is configured to transmit the power supply voltage during the normal display of the display panel, and transmit the first high-voltage detection voltage from the first access ports of the external stress detection terminal 300 during the stress image detection of the display panel. For any power signal line 200, an absolute value of the first high-voltage detection voltage transmitted is greater than an absolute value of the power supply voltage transmitted. The stress-detection-miss detection circuit 400 includes: a prompt information path formed in response to a second high-voltage detection voltage from the second access port of the external stress detection terminal 300 during the stress image detection of the display panel. During a stress-detection-miss detection of the display panel, in response to a low-voltage detection voltage from the second access port of the external stress detection terminal 300, prompt information is generated through the prompt information path. An absolute value of the second high-voltage detection voltage is greater than an absolute value of the low-voltage detection voltage.

The display panel provided by the embodiments of the present disclosure includes multiple power signal lines. Therefore, during the normal display of the display panel, different power signal lines transmit different power supply voltages; and during the stress image detection of the display panel, different power signal lines transmit different first high-voltage detection voltages. For each power signal line, the absolute value of the first high-voltage detection voltage output by the power signal line is greater than the absolute value of the power supply voltage transmitted by the power signal line.

Based on the display panel provided by the foregoing embodiments, the embodiments of the present disclosure also provide a method for detecting stress-detection-miss of the display panel, which is configured to detect the display panel provided by the foregoing embodiments.

The stress-detection-miss method includes: inputting the low-voltage detection voltage to the second access port of the external stress detection terminal, to determine that the stress-detection-miss detection circuit does not generate the prompt information based on the low-voltage detection voltage, thereby determining that the display panel has the stress-detection-miss.

The stress-detection-miss detection circuit provided by the embodiments of the present disclosure includes the prompt information path formed in response to the second high-voltage detection voltage during the stress image detection of the display panel, that the prompt information path can generate the prompt information in response to the low-voltage detection voltage. Furthermore, during the stress image detection of the display panel, whether the display panel has passed the stress image detection can be determined by determining whether the stress-detection-miss detection circuit generates the prompt information based on the low-voltage detection voltage, so as to avoid occurrence of the stress-detection-miss of the display panel, and ensure that the display effect of the display panel is high.

In one embodiment of the present disclosure, the prompt information provided by the present disclosure may include visual prompt information; and the visual prompt information includes lighting information of light-emitting devices, thereby determining whether the display panel has passed the stress image detection by observing lighting states of the light-emitting devices. Optionally, in other embodiments of the present disclosure, the prompt information may also include sound prompt information or sound and lighting prompt information, which is not specifically limited by the present disclosure.

Figure 2:
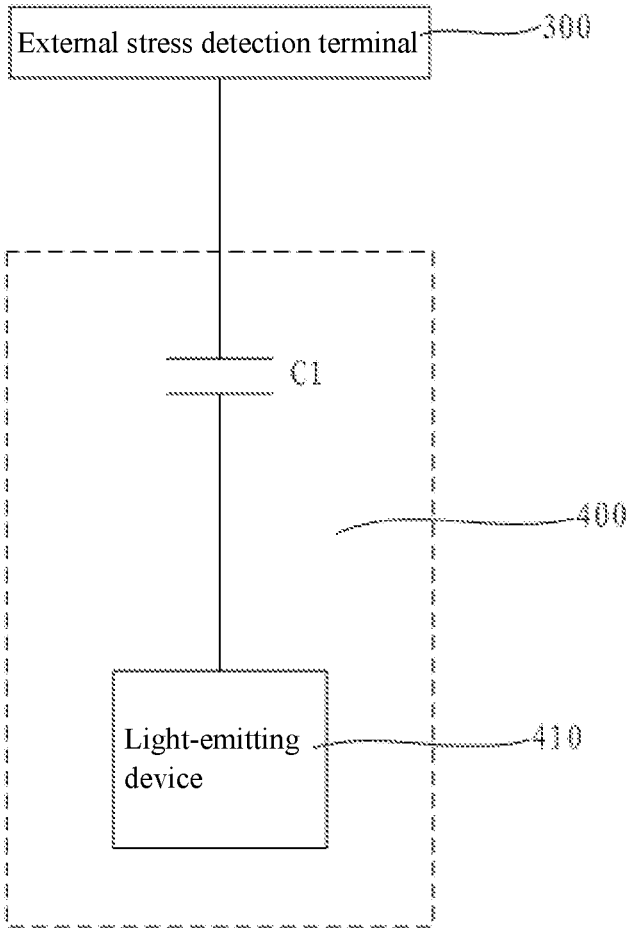
FIG. 2 is a schematic structural diagram of an exemplary stress-detection-miss detection circuit according to various embodiments of the present disclosure.

FIG. 2 is a schematic structural diagram of an exemplary stress-detection-miss detection circuit according to various embodiments of the present disclosure. Referring to FIG. 2, the stress-detection-miss detection circuit 400 provided by the embodiments of the present disclosure includes a first capacitor C1 and a light-emitting device 410. A first plate of the first capacitor C1 is connected to the second access port of the external stress detection terminal 300, and a second plate of the first capacitor C1 is connected to the light-emitting device 410.

With reference to the stress-detection-miss detection circuit 400 shown in FIG. 2, the embodiments of the present disclosure provide a method for detecting stress-detection-miss of a display panel. When the stress-detection-miss detection circuit 400 includes the first capacitor C1 and the light-emitting device 410, and when the stress-detection-miss detection circuit 400 is connected to the second high-voltage detection voltage output from the second access port of the external stress detection terminal 300, the second high-voltage detection voltage can break down the first capacitor C1 to form a prompt information path formed by the broken-down first capacitor C1 and the light-emitting device 410.

The stress-detection-miss method includes: inputting the low-voltage detection voltage to the second access port of the external stress detection terminal 300, to determine that the light-emitting device 410 does not emit light in response to the low-voltage detection voltage, thereby determining that the display panel has the stress-detection-miss, where the low-voltage detection voltage can be provided through an external line that has nothing to do with the power signal lines of the display panel.

Under a condition of a normal voltage and a condition that the first capacitor is not broken down, the first capacitor can play a circuit breaker function, so that the normal voltage cannot be transmitted to the light-emitting device through the first capacitor, and the light-emitting device is in an off state. During the stress image detection of the display panel, the second high-voltage detection voltage is transmitted to the stress-detection-miss detection circuit through the second access port of the external stress detection terminal. Because the second high-voltage detection voltage can break down the first capacitor, that is, during the stress image detection, the second high-voltage detection voltage can not only light up the light-emitting device, but also form the permanent prompt information path formed between the first capacitor and the light-emitting device. Furthermore, in subsequent detection of whether the display panel has the stress-detection-miss, it is only needed to provide the low-voltage detection voltage to the second access port of the external stress detection terminal, and the low-voltage detection voltage can be transmitted to the light-emitting device through the broken-down first capacitor to make the light-emitting device light up. In other words, if an inspector determines that the light-emitting device emits light in response to the low-voltage detection voltage, it means that the display panel has passed the stress image detection; and if it is determined that the light-emitting device does not emit light in response to the low-voltage detection voltage, it means that the display panel has not passed the stress image detection, which requires further processing of the display panel, such as returning the display panel to a node of the stress image detection for re-testing.

Figure 3:
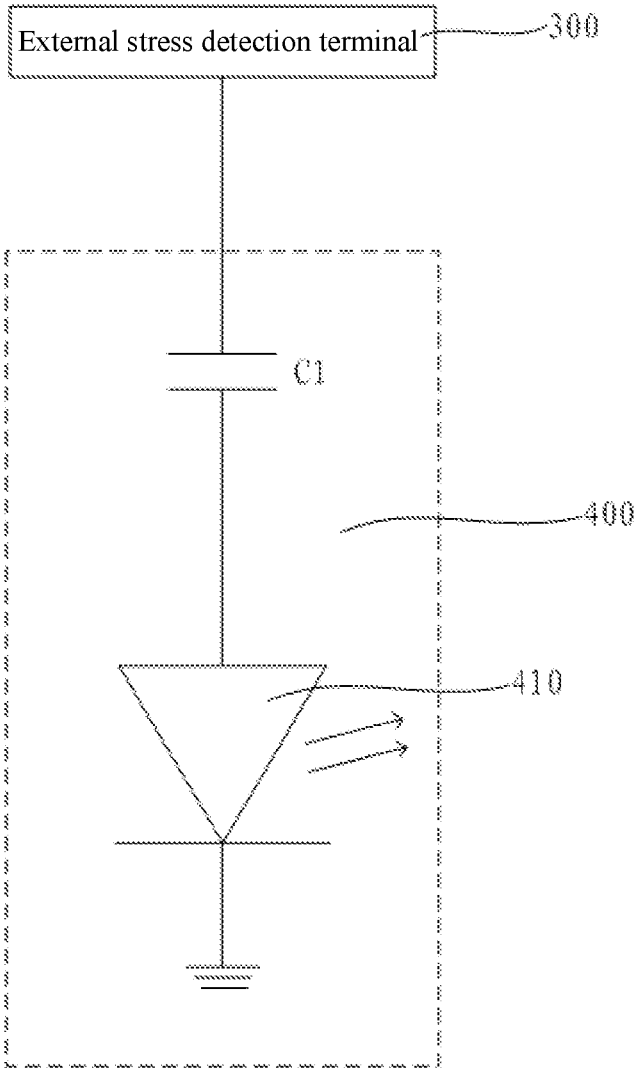
FIG. 3 is a schematic structural diagram of another exemplary stress-detection-miss detection circuit according to various embodiments of the present disclosure.

In one embodiment of the present disclosure, the light-emitting device provided by the present disclosure may be an organic light-emitting diode. As shown in FIG. 3, which is a schematic structural diagram of another exemplary stress-detection-miss detection circuit according to various embodiments of the present disclosure, the second access port of the external stress detection terminal 300 provided by the embodiments of the present disclosure can transmit the second high-voltage detection voltage as a positive voltage. An anode of the organic light-emitting diode 410 is electrically connected to the second plate of the first capacitor C1, and a cathode of the organic light-emitting diode 410 is grounded or connected to a negative voltage. During the stress image detection of the display panel, the second high-voltage detection voltage as the positive voltage breaks down the first capacitor C1 to form a current path from the first capacitor C1 to the organic light-emitting diode 410; and further, when detecting whether the display panel has the stress-detection-miss, the second access port outputs the low-voltage detection voltage as a positive voltage, and by determining whether the organic light-emitting diode 410 emits light, it is determined whether the display panel has the stress-detection-miss.

Figure 4:
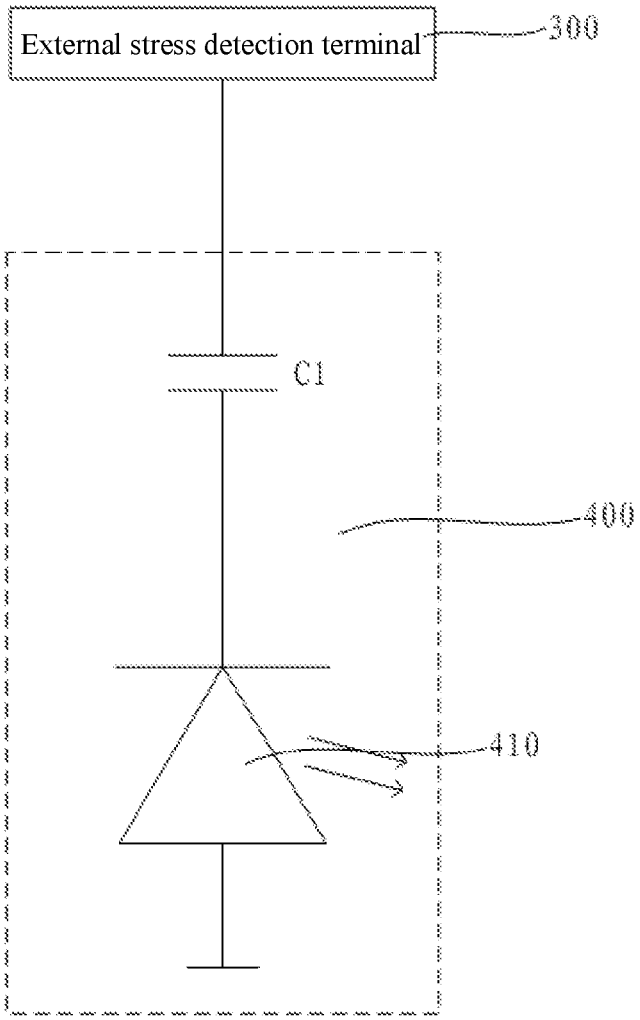
FIG. 4 is a schematic structural diagram of another exemplary stress-detection-miss detection circuit according to various embodiments of the present disclosure.

Or as shown in FIG. 4, which is a schematic structural diagram of another exemplary stress-detection-miss detection circuit according to various embodiments of the present disclosure, the second access port of the external stress detection terminal 300 provided by the embodiments of the present disclosure can transmit the second high-voltage detection voltage as a negative voltage. The cathode of the organic light-emitting diode 410 is electrically connected to the second plate of the first capacitor C1, and the anode of the organic light-emitting diode 410 is connected to a positive voltage. During the stress image detection of the display panel, the second high-voltage detection voltage as the negative voltage breaks down the first capacitor C1 to form a current path from the organic light-emitting diode 410 to the first capacitor C1; and further, when detecting whether the display panel has the stress-detection-miss, the second access port outputs the low-voltage detection voltage as a negative voltage, and by determining whether the organic light-emitting diode 410 emits light, it is determined whether the display panel has the stress-detection-miss.

Figure 5:
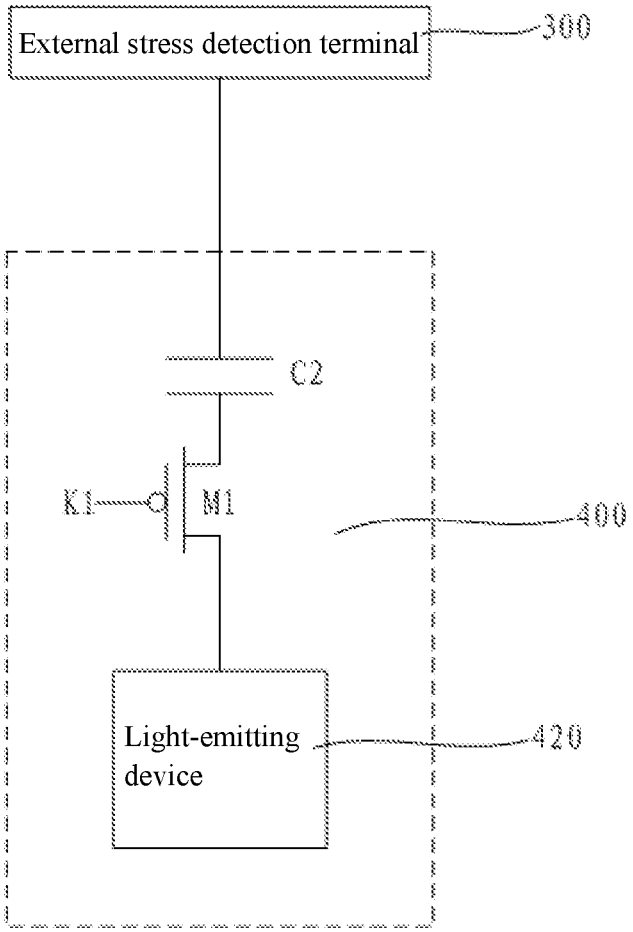
FIG. 5 is a schematic structural diagram of another exemplary stress-detection-miss detection circuit according to various embodiments of the present disclosure.

Referring to FIG. 5, which is a schematic structural diagram of another exemplary stress-detection-miss detection circuit according to various embodiments of the present disclosure, the stress-detection-miss detection circuit 400 provided by the embodiments of the present disclosure includes a second capacitor C2, a first transistor M1, and a light-emitting device 420. A first plate of the second capacitor C2 is connected to the second access port of the external stress detection terminal 300, and a second plate of the second capacitor C2 is connected to a first terminal of the first transistor M1. A second terminal of the first transistor M1 is connected to the light-emitting device 420, a gate of the first transistor M1 is connected to a first control signal K1, and any one of the first access ports of the external stress detection terminal 300 is connected to the second access port.

With reference to the stress-detection-miss detection circuit 400 shown in FIG. 5, the embodiments of the present disclosure provide a method for detecting stress-detection-miss of a display panel. When the stress-detection-miss detection circuit 400 provided by the embodiments of the present disclosure includes the second capacitor C2, the first transistor M1, and the light-emitting device 420, and when the stress-detection-miss detection circuit 400 is connected to the second high-voltage detection voltage output from the second access port of the external stress detection terminal 300, the second high-voltage detection voltage breakdowns the second capacitor C2.

The stress-detection-miss method includes: controlling the first transistor M1 to be turned on. The first transistor M1 can be an N-type transistor or a P-type transistor. During the stress image detection and the stress-detection-miss detection, the first control signal K1 selects and outputs a corresponding voltage signal according to a type of the first transistor M1 to control the first transistor M1 to be turned on. During the normal display of the display panel, the first control signal K1 selects and outputs a corresponding voltage signal to control the first transistor M1 to be turned off.

The stress-detection-miss method further includes: inputting the second access port of the external stress detection terminal 300 with the power supply voltage transmitted by a power signal line 200 through a first access port connected to the second access port, the power supply voltage being the low-voltage detection voltage, to determine that the light-emitting device 420 does not emit light in response to the low-voltage detection voltage, thereby determining that the display panel has the stress-detection-miss. The low-voltage detection voltage is provided by the power signal line 200 connected to the second access port.

The second access port provided by the embodiments of the present disclosure is connected to any one of the first access ports, that is, the second access port is electrically connected to a corresponding power signal line. The voltage output by the second access port is substantially the same as the voltage transmitted by the power signal line connected to the second access port, that is to say, the second high-voltage detection voltage is essentially the first high-voltage detection voltage transmitted by the power signal line connected to the second access port, and the low-voltage detection voltage is essentially the power supply voltage transmitted by the power signal line connected to the second access port.

Under a condition of a normal voltage and a condition that the second capacitor is not broken down, the second capacitor can play a circuit breaker function, so that the normal voltage cannot be transmitted to the light-emitting device through the second capacitor and the first transistor, and the light-emitting device is in the off state. During the stress image detection of the display panel, the second high-voltage detection voltage is transmitted to the stress-detection-miss detection circuit through the second access port of the external stress detection terminal. Because the second high-voltage detection voltage can break down the second capacitor, that is, during the stress image detection, the second high-voltage detection voltage can not only light up the light-emitting device, but also can form a permanent prompt information path between the second capacitor, the turned-on first transistor, and the light-emitting device. Furthermore, in subsequent detection of whether the display panel has the stress-detection-miss, it is only needed to provide the low-voltage detection voltage to the second access port of the external stress detection terminal, and the low-voltage detection voltage can be transmitted to the light-emitting device through the broken-down second capacitor and the turned-on first transistor to make the light-emitting device light up. In other words, if the inspector determines that the light-emitting device emits light in response to the low-voltage detection voltage, it means that the display panel has passed the stress image detection; and if it is determined that the light-emitting device does not emit light in response to the low-voltage detection voltage, it means that the display panel has not passed the stress image detection, which requires further processing of the display panel, such as returning the display panel to the node of the stress image detection for re-testing.

Figure 6:
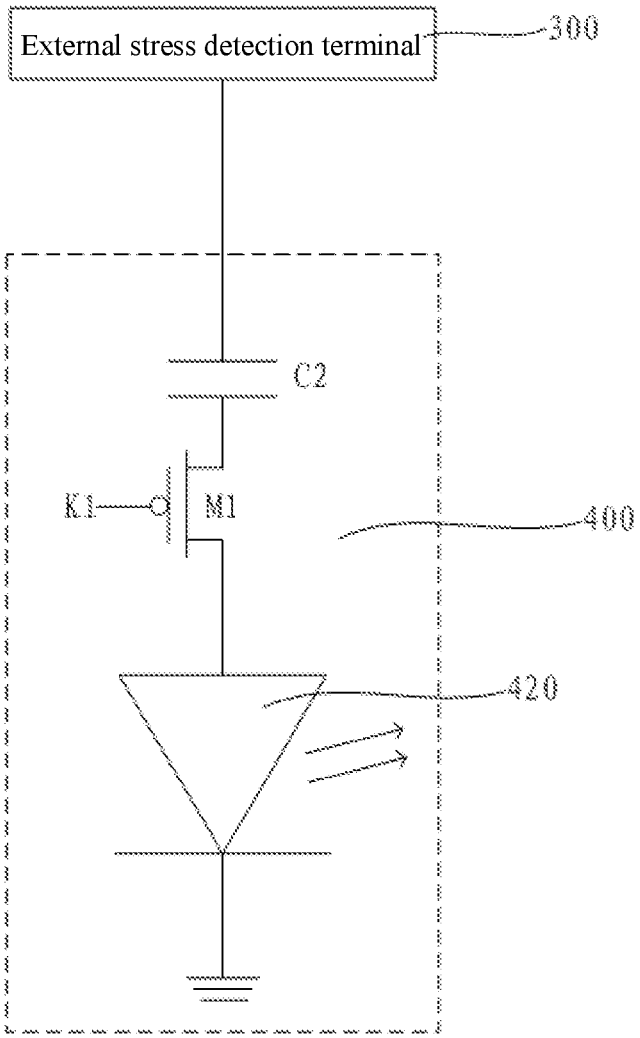
FIG. 6 is a schematic structural diagram of another exemplary stress-detection-miss detection circuit according to various embodiments of the present disclosure.

In one embodiment of the present disclosure, the light-emitting device provided by the present disclosure may be an organic light-emitting diode. As shown in FIG. 6, which is a schematic structural diagram of another exemplary stress-detection-miss detection circuit according to various embodiments of the present disclosure, the second access port of the external stress detection terminal 300 provided by the embodiments of the present disclosure can be connected to a first access port corresponding to a power signal line that transmits a positive voltage. An anode of an organic light-emitting diode 420 is electrically connected to the second terminal of the first transistor M1, and a cathode of the organic light-emitting diode 420 is grounded or connected to a negative voltage. During the stress image detection of the display panel, the first transistor M1 is turned on, and the second high-voltage detection voltage as the positive voltage breaks down the second capacitor C2 to form a current path from the second capacitor C2 to the organic light-emitting diode 420; and further, when detecting whether the display panel has the stress-detection-miss, a power supply voltage line connected to the second access port transmits the power supply voltage as a positive voltage, so that the second access port outputs the low-voltage detection voltage as the positive voltage, and by determining whether the organic light-emitting diode 420 emits light, it is determined whether the display panel has the stress-detection-miss.

Figure 7:
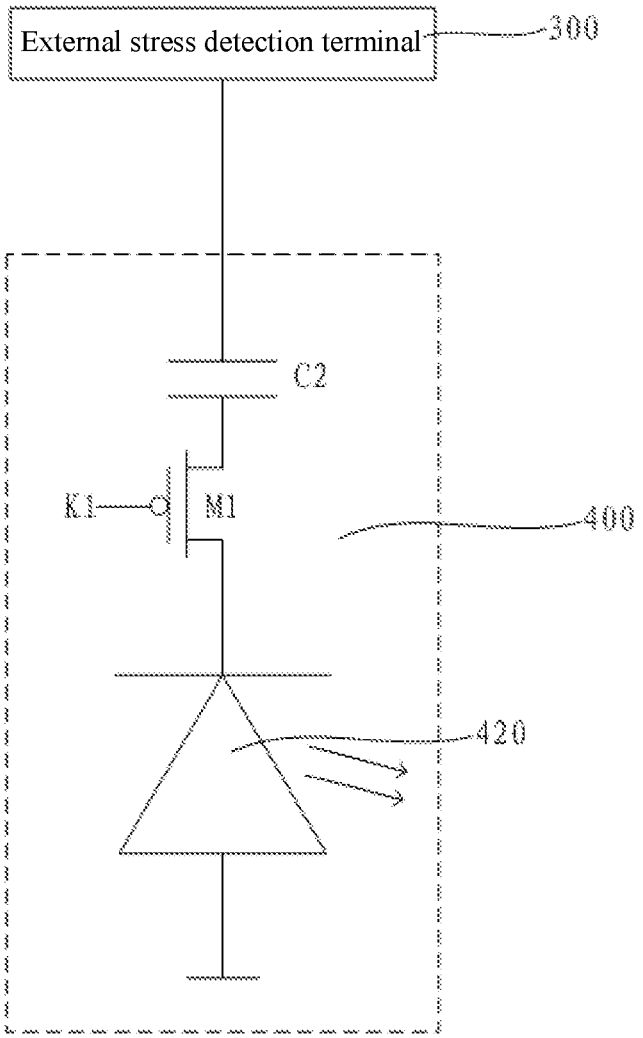
FIG. 7 is a schematic structural diagram of another exemplary stress-detection-miss detection circuit according to various embodiments of the present disclosure.

Or as shown in FIG. 7, which is a schematic structural diagram of another exemplary stress-detection-miss detection circuit according to various embodiments of the present disclosure, the second access port of the external stress detection terminal 300 provided by the embodiments of the present disclosure is connected to a first access port corresponding to a power signal line that transmits a negative voltage. The cathode of the organic light-emitting diode 420 is electrically connected to the second terminal of the first transistor M1, and the anode of the organic light-emitting diode 420 is connected to a positive voltage. During the stress image detection of the display panel, the first transistor M1 is turned on, and the second high-voltage detection voltage as the negative voltage breaks down the second capacitor C2 to form a current path from the organic light-emitting diode 420 to the second capacitor C2; and further, when detecting whether the display panel has the stress-detection-miss, a power supply voltage line connected to the second access port transmits the power supply voltage as a negative voltage, so that the second access port outputs the low-voltage detection voltage as the negative voltage, and by determining whether the organic light-emitting diode 420 emits light, it is determined whether the display panel has the stress-detection-miss.

Figure 8:
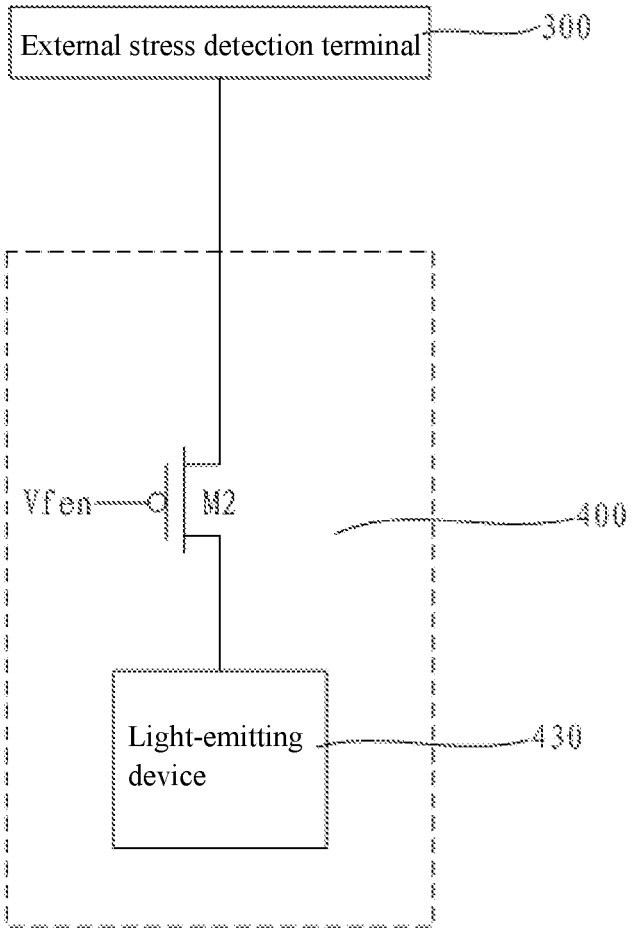
FIG. 8 is a schematic structural diagram of another exemplary stress-detection-miss detection circuit according to various embodiments of the present disclosure.

Referring to FIG. 8, which is a schematic structural diagram of another exemplary stress-detection-miss detection circuit according to various embodiments of the present disclosure, the stress-detection-miss detection circuit 400 provided by the embodiments of the present disclosure includes a second transistor M2 and a light-emitting device 430. A first terminal of the second transistor M2 is connected to the second access port of the external stress detection terminal 300, a second terminal of the second transistor M2 is connected to the light-emitting device 430, and a gate of the second transistor M2 is connected to a non-enable voltage Vfen.

With reference to the stress-detection-miss detection circuit 400 shown in FIG. 8, the stress-detection-miss detection circuit 400 provided by the embodiments of the present disclosure includes the second transistor M2 and the light-emitting device 430. When the stress-detection-miss detection circuit 400 is connected to the second high-voltage detection voltage output from the second access port of the external stress detection terminal 300, a threshold voltage of the second transistor M2 is positively biased.

The stress-detection-miss method includes: inputting the low-voltage detection voltage to the second access port of the external stress detection terminal 300, to determine that the light-emitting device 430 does not emit light in response to the low-voltage detection voltage, thereby determining that the display panel has the stress-detection-miss.

During the stress image detection of the display panel, the second high-voltage detection voltage is transmitted to the stress-detection-miss detection circuit through the second access port of the external stress detection terminal, and the second high-voltage detection voltage can positively bias the threshold voltage of the second transistor. Furthermore, in subsequent detection of whether the display panel has the stress-detection-miss, it is only needed to provide the low-voltage detection voltage to the second access port of the external stress detection terminal, and the low-voltage detection voltage can be transmitted to the light-emitting device through the positively-biased second transistor to make the light-emitting device light up. In other words, if the inspector determines that the light-emitting device emits light in response to the low-voltage detection voltage, it means that the display panel has passed the stress image detection; and if it is determined that the light-emitting device does not emit light in response to the low-voltage detection voltage, it means that the display panel has not passed the stress image detection, which requires further processing of the display panel, such as returning the display panel to the node of the stress image detection for re-testing.

Figure 9:
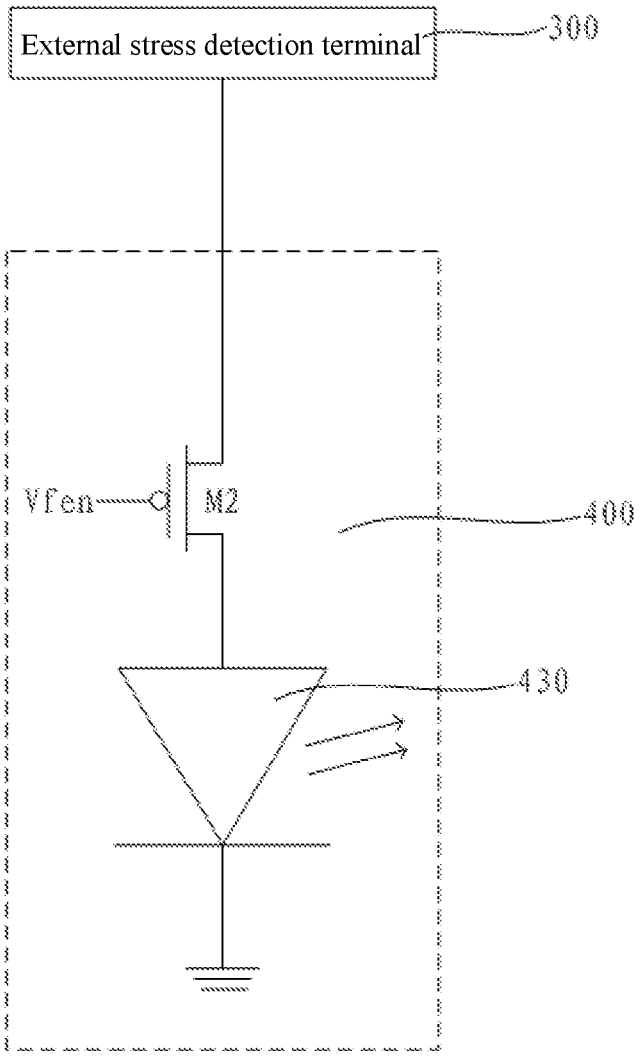
FIG. 9 is a schematic structural diagram of another exemplary stress-detection-miss detection circuit according to various embodiments of the present disclosure.

As shown in FIG. 9, which is a schematic structural diagram of another exemplary stress-detection-miss detection circuit according to various embodiments of the present disclosure, the second transistor M2 provided by the embodiments of the present disclosure may be a P-type transistor, the non-enable voltage Vfen is a high-level voltage, and the low-voltage detection voltage is a sum of the high-level voltage and a preset voltage. The light-emitting device 430 provided by the embodiments of the present disclosure may be an organic light-emitting diode, an anode of an organic light-emitting diode 430 is electrically connected to the second terminal of the second transistor M2, and a cathode of the organic light-emitting diode 430 is grounded or connected to a negative voltage. Optionally, the preset voltage provided by the embodiments of the present disclosure is the same as the threshold voltage of the second transistor M2, or the preset voltage is greater than the threshold voltage of the second transistor M2.

Figure 10:
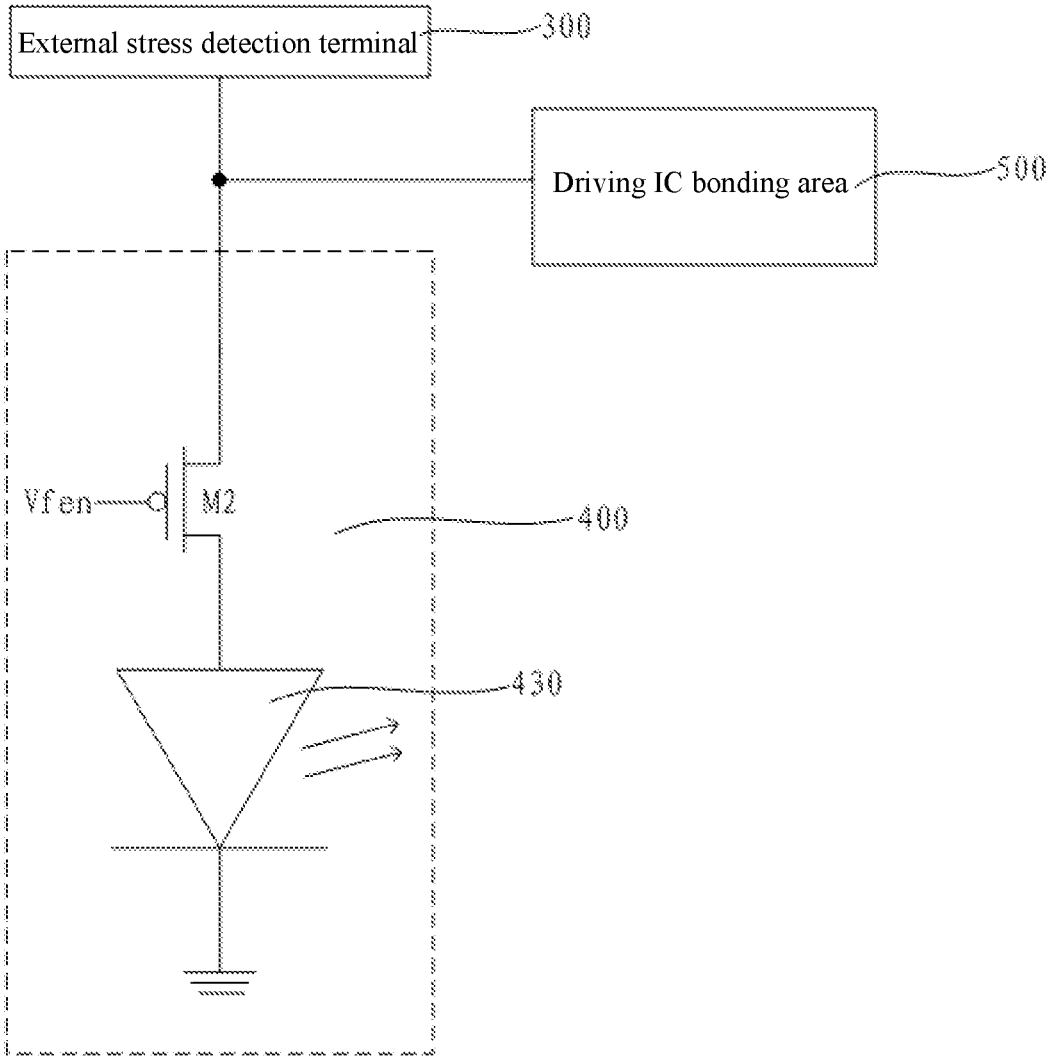
FIG. 10 is a schematic structural diagram of another exemplary stress-detection-miss detection circuit according to various embodiments of the present disclosure.

In one embodiment of the present disclosure, when the stress-detection-miss detection circuit provided by the present disclosure includes the second transistor and the light-emitting device, the low-voltage detection voltage may be provided by an external circuit that has nothing to do with the display panel. Alternatively, the low-voltage detection voltage may also be provided by a driving chip. As shown in FIG. 10, which is a schematic structural diagram of another exemplary stress-detection-miss detection circuit according to various embodiments of the present disclosure, the stress-detection-miss detection circuit 400 provided by the embodiments of the present disclosure includes the second transistor M2 and the light-emitting device 430. The first terminal of the second transistor M2 is connected to the second access port of the external stress detection terminal 300, the second terminal of the second transistor M2 is connected to the light-emitting device 430, and the gate of the second transistor M2 is connected to the non-enable voltage Vfen. The second access port of the external stress detection terminal 300 is connected to a port of a driving IC bonding area 500 of the display panel.

With reference to the stress-detection-miss detection circuit 400 shown in FIG. 10, the stress-detection-miss detection circuit 400 includes the second transistor M2 and the light-emitting device 430. When the second access port of the external stress detection terminal 300 is connected to the port of the driving IC bonding area 500 of the display panel, the threshold voltage of the second transistor M2 is positively biased when the stress-detection-miss detection circuit 400 is connected to the second high-voltage detection voltage.

The stress-detection-miss method includes: bonding a driving chip to the driving IC bonding area 500 of the display panel.

The stress-detection-miss method further includes: controlling the driving chip to input the low-voltage detection voltage to the second access port of the external stress detection terminal 300, to determine that the light-emitting device 430 does not emit light in response to the low-voltage detection voltage, thereby determining that the display panel has the stress-detection-miss.

The stress-detection-miss process of the display panel provided by the embodiments of the present disclosure can be performed after the driving chip is bonded to the driving IC bonding area, and further, the low-voltage detection voltage is output from the driving chip to the second access port to detect, to perform a detection through the stress-detection-miss detection circuit.

Figure 11A:
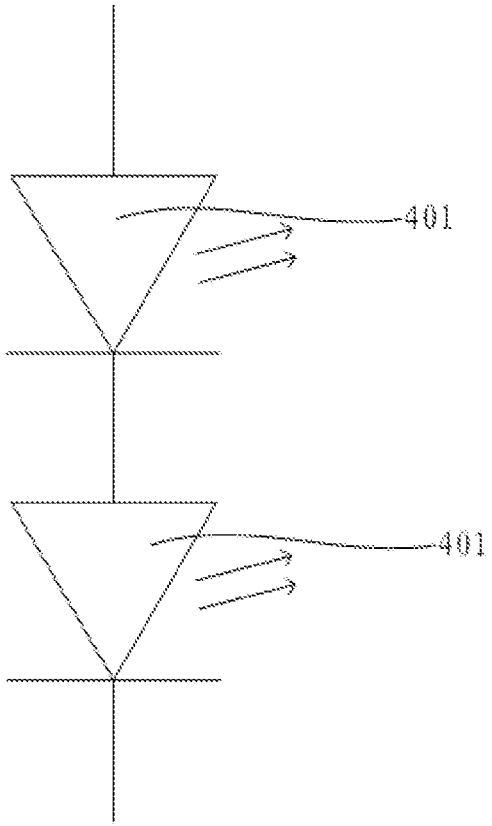
FIG. 11*a* is a schematic structural diagram of an exemplary light-emitting device according to various embodiments of the present disclosure.
Figure 11B:
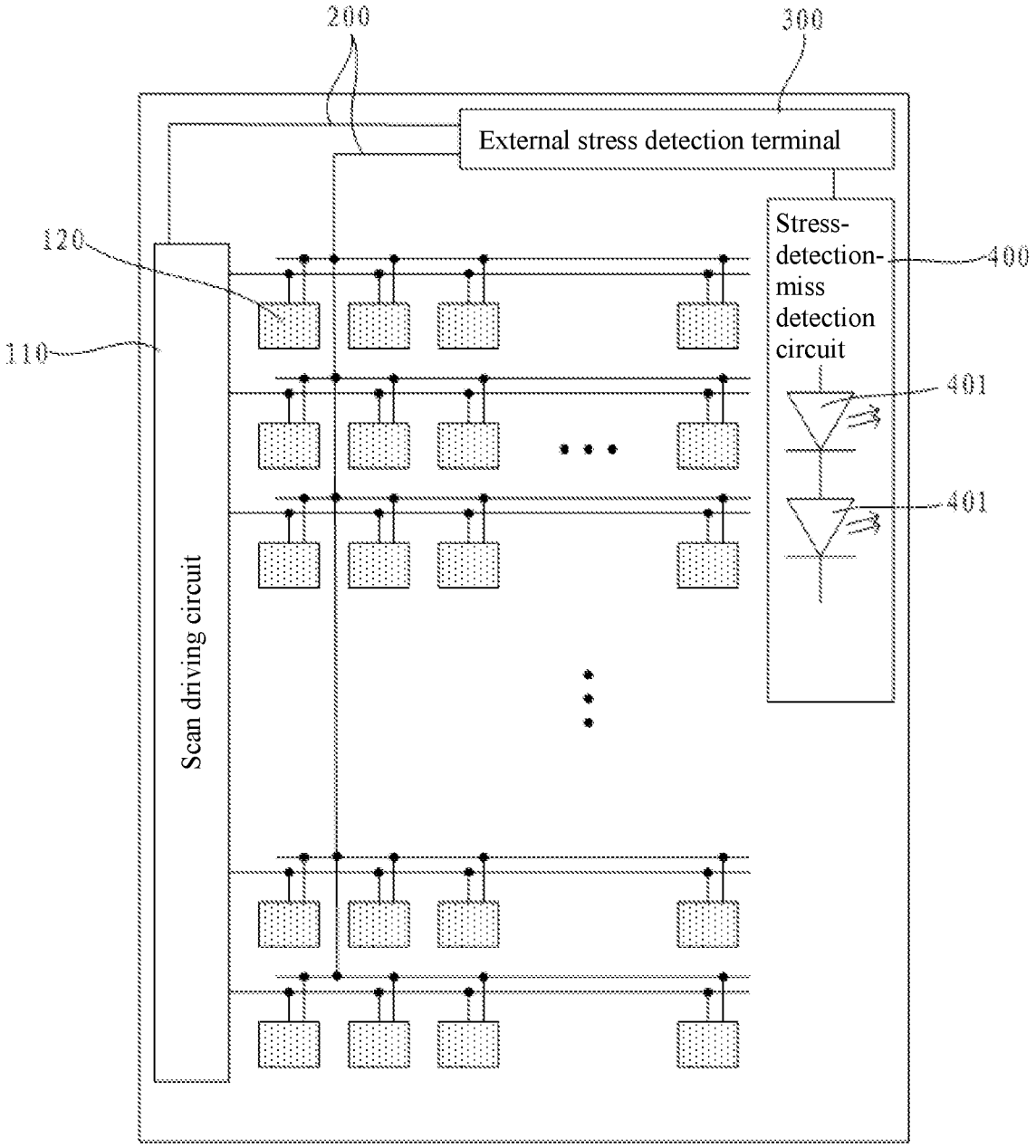
FIG. 11*b* is a schematic structural diagram of another exemplary display panel according to various embodiments of the present disclosure.

In any of the foregoing embodiments, the light-emitting device provided by the present disclosure may be an organic light-emitting diode, and the organic light-emitting diode may have any light-emitting color, such as red, blue, green, etc. The organic light-emitting diode provided by the embodiments of the present disclosure may have a single chip structure. Or, as shown in FIG. 11*a*, which is a schematic structural diagram of an exemplary light-emitting device according to various embodiments of the present disclosure, the organic light-emitting diode included in the light-emitting device provided by the embodiments of the present disclosure is a set of a plurality of sub-organic light-emitting diodes 401, and all sub-organic light-emitting diodes 401 may be connected in series to form the light-emitting device. The plurality of sub-organic light-emitting diodes connected in series can be arranged at an edge of a pixel unit array of the display panel. As shown in FIG. 11*b*, which is a schematic structural diagram of another exemplary light-emitting device according to various embodiments of the present disclosure, the stress-detection-miss detection circuit 400 includes the plurality of sub-organic light-emitting diodes 401 connected in series at the edge of the pixel unit array, which is not specifically limited by the present disclosure.

Figure 12A:
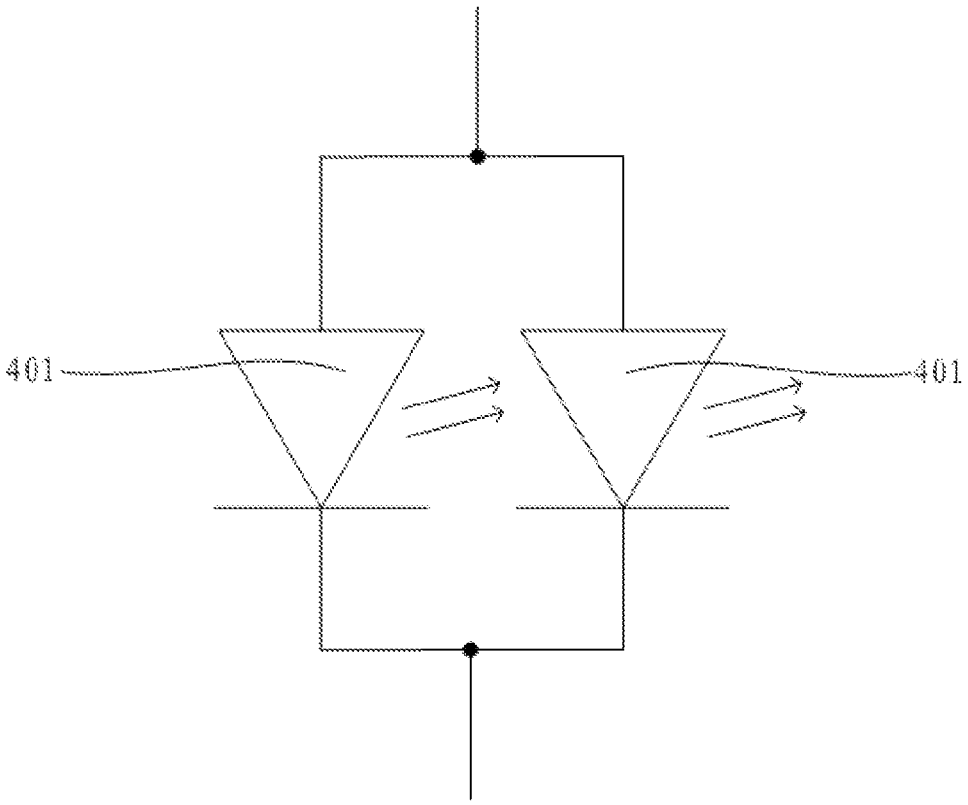
FIG. 12*a* is a schematic structural diagram of another exemplary light-emitting device according to various embodiments of the present disclosure.
Figure 12B:
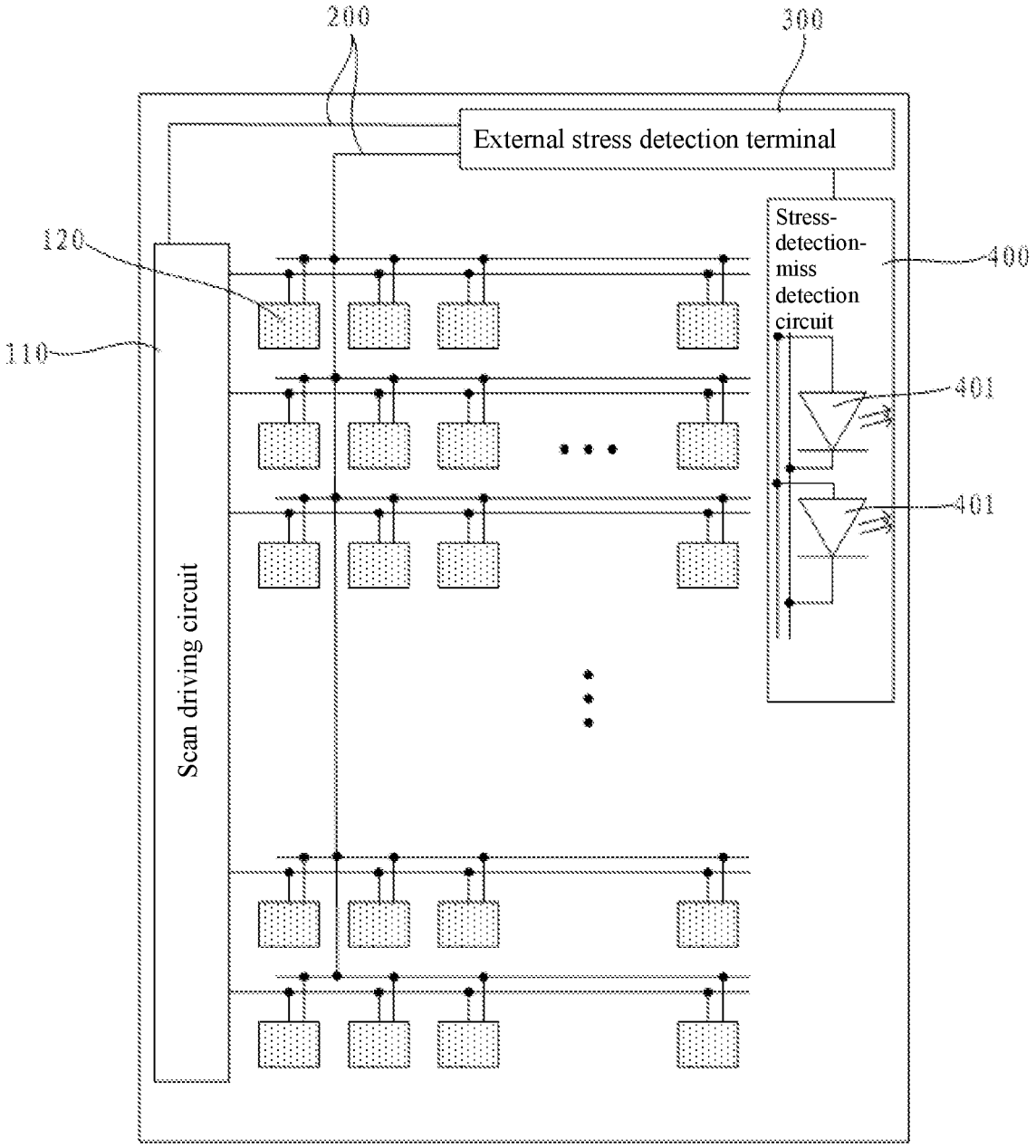
FIG. 12*b* is a schematic structural diagram of another exemplary display panel according to various embodiments of the present disclosure.

Or, as shown in FIG. 12*a*, which is a schematic structural diagram of another exemplary light-emitting device according to various embodiments of the present disclosure, when the light-emitting device provided by the embodiments of the present disclosure includes a set of the plurality of sub-organic light-emitting diodes 401, all sub-organic light-emitting diodes 401 can be connected in parallel, to form the light-emitting device. The plurality of sub-organic light-emitting diodes connected in parallel can be arranged at an edge of the pixel unit array of the display panel. As shown in FIG. 12*b*, which is a schematic structural diagram of another exemplary light-emitting device according to various embodiments of the present disclosure, the stress-detection-miss detection circuit 400 provided by the embodiments of the present disclosure includes the plurality of sub-organic light-emitting diodes 401 connected in parallel at the edge of the pixel unit array, which is not specifically limited by the present disclosure.

Or, when the light-emitting device provided by the embodiments of the present disclosure includes a set of the plurality of sub-organic light-emitting diodes, all the sub-organic light-emitting diodes can be partially connected in parallel, and after being partially connected in parallel, two parts are connected in series to form the light-emitting device, which is not specifically limited by the present disclosure.

Figure 13:
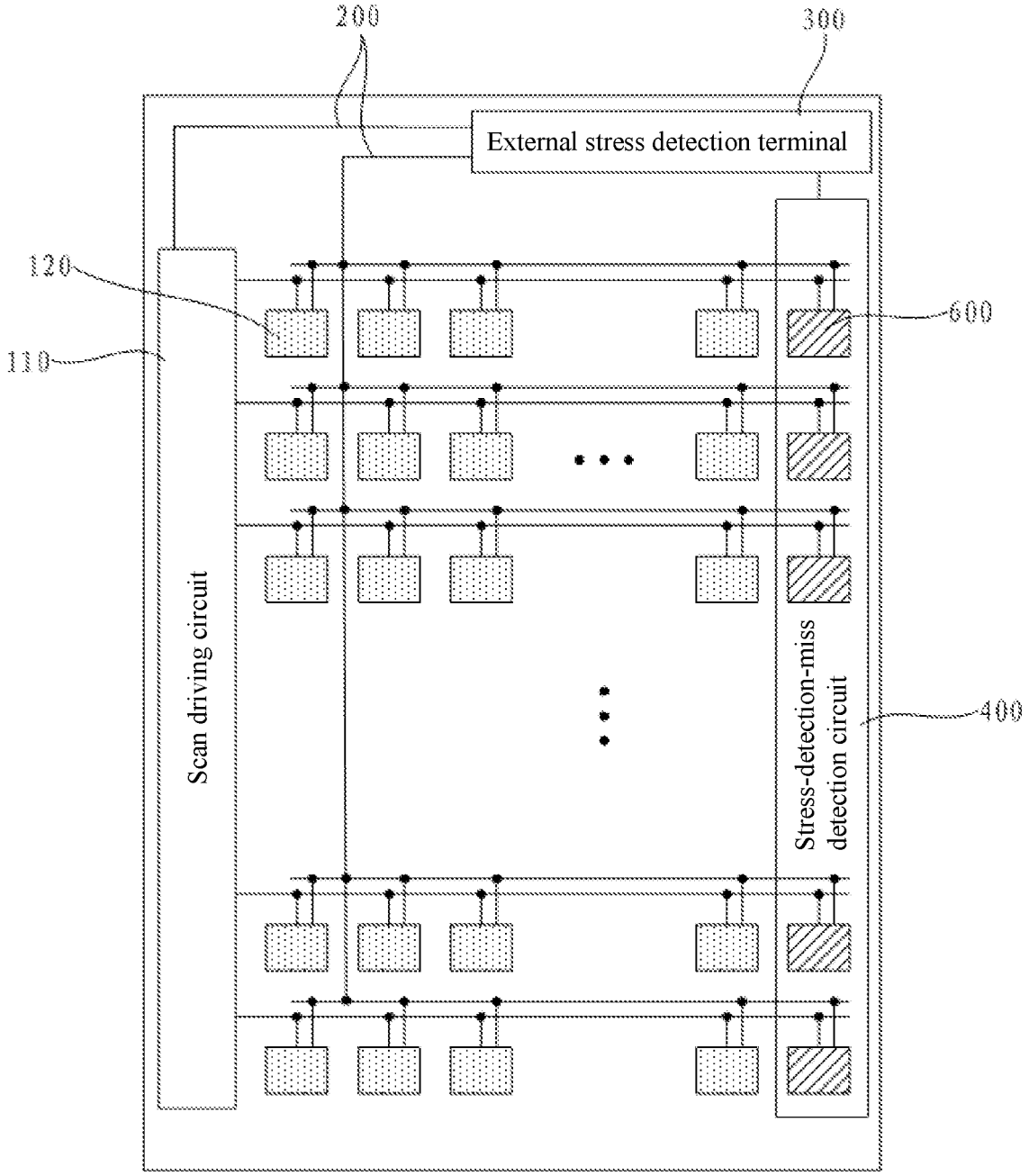
FIG. 13 is a schematic structural diagram of another exemplary display panel according to various embodiments of the present disclosure.

The display panel provided by the embodiments of the present disclosure includes dummy pixel units located in a non-display area, that organic light-emitting diodes provided by the embodiments of the present disclosure can reuse organic light-emitting diodes in the dummy pixel units in the display panel. As shown in FIG. 13, which is a schematic structural diagram of another exemplary display panel according to various embodiments of the present disclosure, the display panel has a plurality of dummy pixel units 600, and the plurality of dummy pixel units 600 can be located in any side edge of an array formed by pixel units 120 (that is, in the array of the pixel units provided by the embodiments of the present disclosure, pixel units in an end row and/or end column on either side of a row arrangement direction and/or column arrangement direction may be the dummy pixel units; and for this case, the stress-detection-miss detection circuit provided by the embodiments of the present disclosure can reuse organic light-emitting diodes of the dummy pixel units in a same row or column, or reuse organic light-emitting diodes in a different row or column, etc., which is not specifically limited by the present disclosure). The light-emitting device reuses the organic light-emitting diodes of the plurality of dummy pixel units 600. Optionally, the organic light-emitting diodes provided by the embodiments of the present disclosure can reuse the organic light-emitting diodes of the dummy pixel units located on any side of the display area, which is designed according to actual applications, and is not specifically limited by the present disclosure.

Alternatively, the organic light-emitting diodes provided by the embodiments of the present disclosure may be a separately manufactured device, which is not specifically limited by the present disclosure.

Figure 14:
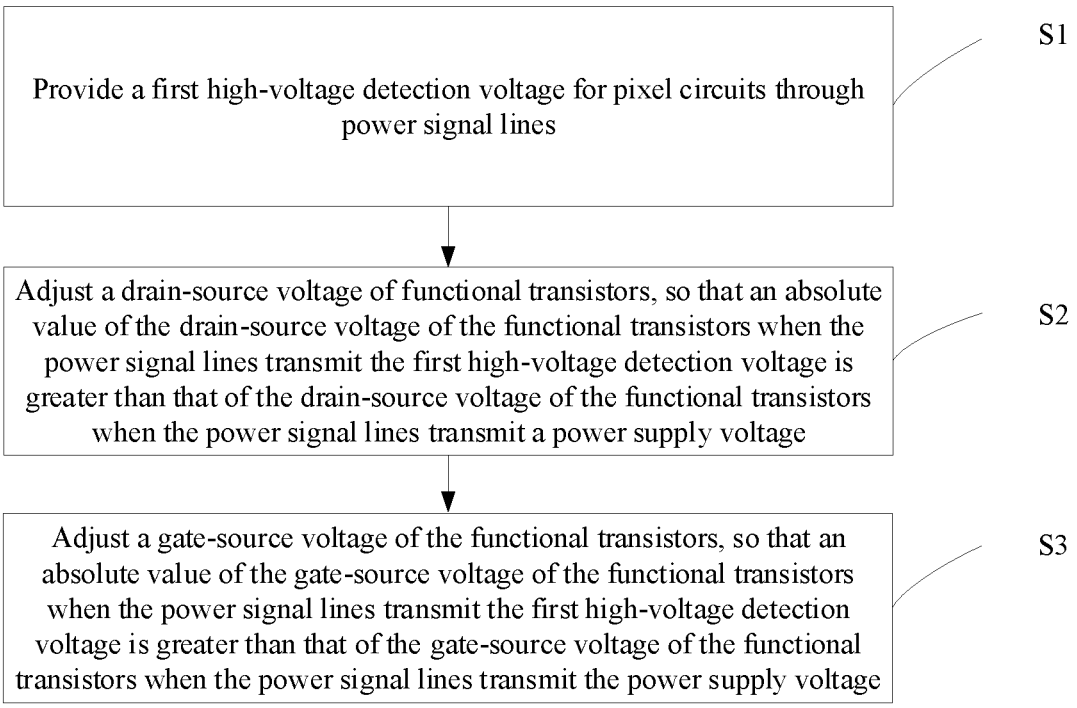
FIG. 14 is a flowchart of a stress image detection method for an exemplary display panel according to various embodiments of the present disclosure.
Figure 15:
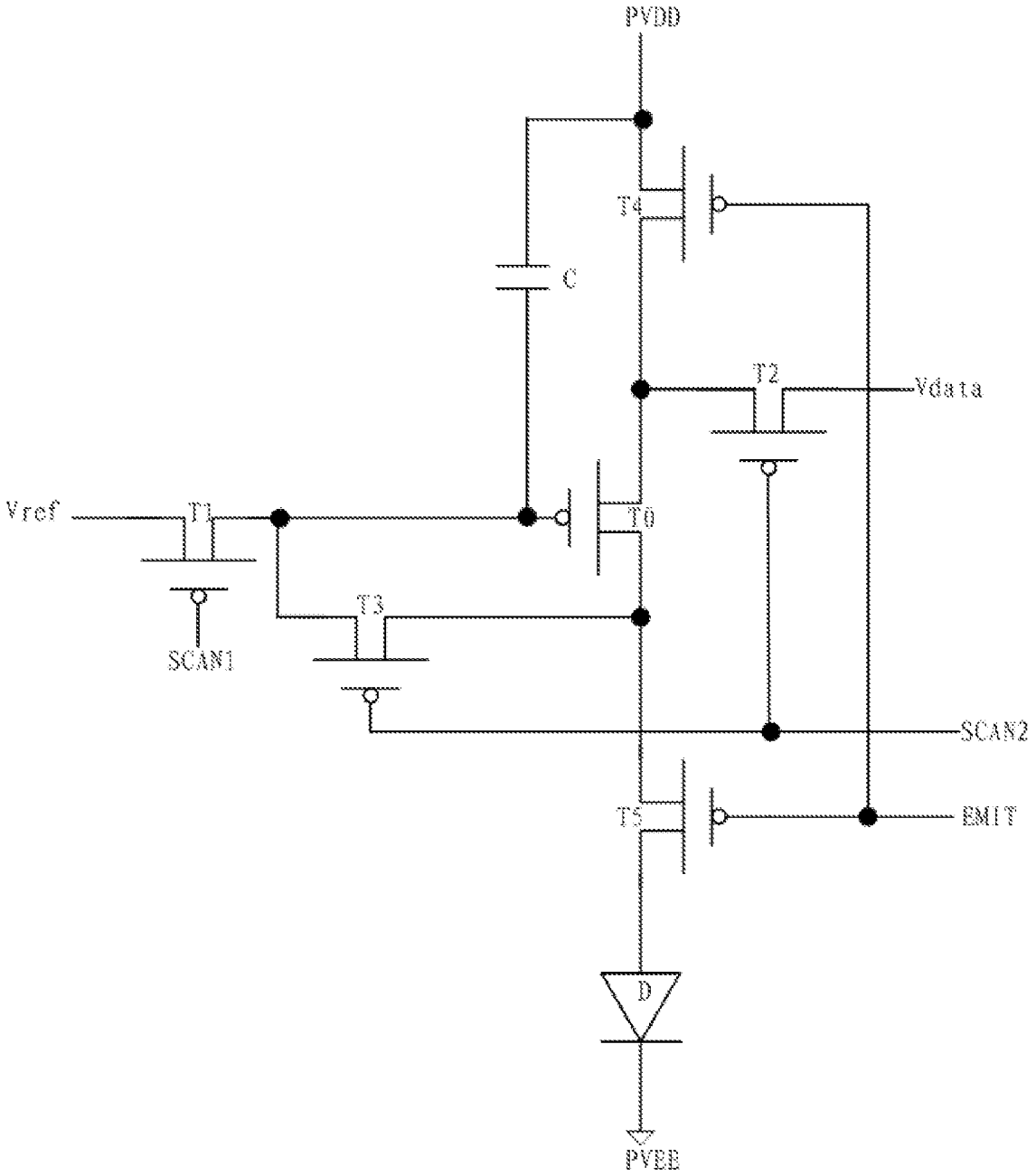
FIG. 15 is a schematic structural diagram of an exemplary pixel circuit according to various embodiments of the present disclosure.

In one embodiment of the present disclosure, after it is detected that the display panel has the stress-detection-miss in the present disclosure, the display panel can be re-tested for the stress image detection, as shown in FIG. 14, which is a flowchart of a stress image detection method for an exemplary display panel according to various embodiments of the present disclosure. After it is determined that the display panel has the stress-detection-miss, the display panel is subjected to the stress image detection. The display driving circuit includes the pixel circuits, and the pixel circuits include driving transistors (the driving transistors are transistors that provide driving currents for light-emitting elements in the pixel circuits) and at least one of functional transistors electrically connected to gates of the driving transistors. Performing the stress image detection on the display panel includes steps S1, S2, and S3.

In S1, a first high-voltage detection voltage is provided for the pixel circuits through the power signal lines.

In S2, a drain-source voltage of all the functional transistors is adjusted, so that an absolute value of the drain-source voltage of the functional transistors when the power signal lines transmit the first high-voltage detection voltage is greater than an absolute value of the drain-source voltage of the functional transistors when the power signal lines transmit the power supply voltage. The drain-source voltage is a difference that a drain voltage of the functional transistors minus a source voltage of the functional transistors.

In S3, a gate-source voltage of all the functional transistors is adjusted, so that an absolute value of the gate-source voltage of the functional transistors when the power signal lines transmit the first high-voltage detection voltage is greater than an absolute value of the gate-source voltage of the functional transistors when the power signal lines transmit the power supply voltage. The gate-source voltage is a difference that a gate voltage of the functional transistors minus the source voltage of the functional transistors.

The stress image detection method provided by the embodiments of the present disclosure can be performed after a reliability test of the display panel, which is not specifically limited by the present disclosure. In the stress image detection method, relevant power signal lines are controlled according to a predetermined strategy to provide corresponding first high-voltage detection voltages for the pixel circuits, that is, through the predetermined strategy, the first high-voltage detection voltages are provided to the corresponding power signal lines through the first access ports of the external stress detection terminal. The power signal lines directly connected to the pixel circuits can directly provide the first high-voltage detection voltages for the pixel circuits; and the power signal lines connected to the scan driving circuit can indirectly provide the first high-voltage detection voltages for the pixel circuits through the scan driving circuit. Furthermore, the power supply signal lines are controlled through the predetermined strategy to achieve the purpose of adjusting the drain-source voltage of the functional transistors, that is, compared with the drain-source voltage of the functional transistors during the normal display of the display panel, the drain-source voltage of the functional transistors is increased during the stress image detection. The drain-source voltage of the functional transistors during the stress image detection is alternatively greater than 2-7 times (including endpoint values) of the drain-source voltage of the functional transistors during the normal display, so as to repair the functional transistors. The purpose of adjusting the gate-source voltage of the functional transistors is to adjust the gate-source voltage of the functional transistors during the stress image detection to be increased, compared to the gate-source voltage of the functional transistors during the normal display of the display panel, to repair the functional transistors. Finally, through the repaired functional transistors, high voltage stability at the gates of the driving transistors is ensured.

In one embodiment of the present disclosure, during the stress image detection of the display panel, the voltages at the sources of the functional transistors may be adjusted separately, the voltages at the drains of the functional transistors may be adjusted separately, or the voltages at both the sources and drains of the functional transistors may be adjusted, to achieve the purpose of adjusting the drain-source voltage of the functional transistors. During the stress image detection of the display panel, the voltages at the sources of the functional transistors can be adjusted separately, the voltages at the gates of the functional transistors can be adjusted separately, or the voltages at both the sources and gates of the functional transistors can be adjusted, to achieve the purpose of adjusting the gate-source voltage of the functional transistors, which is not specifically limited by the present disclosure.

The stress image detection method provided by the embodiments of the present disclosure will be described below in conjunction with an alternative pixel circuit. Alternatively with reference to FIG. 15, which is a schematic structural diagram of an exemplary pixel circuit according to various embodiments of the present disclosure, a pixel circuit includes: a driving transistor T0; a reset transistor T1, that a first terminal of the reset transistor T1 is electrically connected to a Vref signal line that provides a reference voltage, a gate of the reset transistor T1 is connected to a scan control voltage SCAN1, and a second terminal of the reset transistor T1 is electrically connected to a gate of the driving transistor T0; a first data writing transistor T2 and a second data writing transistor T3, that both gates of the first data writing transistor T2 and the second data writing transistor T3 are connected to a scan control voltage SCAN2, a first terminal of the first data writing transistor T2 is connected to a data voltage Vdata, a second terminal of the first data writing transistor T2 is electrically connected to a first terminal of the driving transistor T0, a first terminal of the second data writing transistor T3 is electrically connected to the gate of the driving transistor T0, and a second terminal of the second data writing transistor T3 is electrically connected to a second terminal of the driving transistor T0; a first light-emitting control transistor T4 and a second light-emitting control transistor T5, that both gates of the first light-emitting control transistor T4 and the second light-emitting control transistor T5 are connected to a light-emitting control voltage EMIT1, a first terminal of the first light-emitting control transistor T4 is electrically connected to a PVDD signal line that provides an anode voltage, a second terminal of the first light-emitting control transistor T4 is electrically connected to the first terminal of the driving transistor T0, a first terminal of the second light-emitting control transistor T5 is electrically connected to the second terminal of the driving transistor T0, a second terminal of the second light control transistor T5 is electrically connected to a first terminal of a light-emitting element D (the light-emitting element D may be an organic light-emitting diode), and a second terminal of the light-emitting element D is electrically connected to a PVEE signal line that provides a cathode voltage; and a storage capacitor C, that a first plate of the storage capacitor C is electrically connected to the PVDD signal line, and a second plate of the storage capacitor C is electrically connected to the gate of the driving transistor T0. The Vref signal line, the PVDD signal line, and the PVEE signal line, are the power signal lines directly electrically connected to the pixel circuit, and the scan control voltage SCAN1 and the scan control voltage SCAN2 are the power supply voltages provided by the power signal lines in the display driving circuit connected to the scan driving circuit. The reset transistor T1 and the second data writing transistor T3 are the functional transistors electrically connected to the gate of the driving transistor T0. When performing the stress image detection on the pixel circuit of the display panel, the first high-voltage detection voltages are provided to the pixel circuit through each power signal line according to the predetermined strategy, so as to achieve the purpose of increasing the absolute value of the voltage at the source and/or drain of the reset transistor T1 (the increase is compared to the voltage at the source and drain of the reset transistor T1 during the normal display), to make the absolute value of the drain-source voltage of the reset transistor T1 during the stress image detection of the display panel greater than the absolute value of the drain-source voltage during the normal display of the display panel, alternatively greater than 2-7 times of the absolute value of the drain-source voltage during the normal display of the display panel, including endpoint values; and to achieve the purpose of increasing the absolute value of the voltage at the source and/or drain of the second data writing transistor T3 (the increase is compared to the voltage at the source and drain of the second data writing transistor T3 during the normal display), to make the absolute value of the drain-source voltage of the second data writing transistor T3 during the stress image detection of the display panel greater than the absolute value of the drain-source voltage during the normal display of the display panel, alternatively greater than 2-7 times of the absolute value of the drain-source voltage during the normal display of the display panel, including endpoint values.

And, through each power signal line according to the predetermined strategy, the first high-voltage detection voltages are provided for the pixel circuit, so as to achieve the purpose of increasing the absolute value of the voltage at the source and/or gate of the reset transistor T1 (the increase is compared with the voltage at the source and gate of the transistor T1 during the normal display), to make the absolute value of the gate-source voltage of the reset transistor T1 during the stress image detection of the display panel greater than the gate-source voltage of the reset transistor T1 during the normal display of the display panel, alternatively greater than 2-7 times of the gate-source voltage of the reset transistor T1 during the normal display of the display panel, including endpoint values; and to achieve the purpose of increasing the absolute value of the voltage at the source and/or gate of the second data writing transistor T3 (the increase is compared with the voltage at the source and gate of the second data writing transistor T3 during the normal display), to make the absolute value of the gate-source voltage of the second data writing transistor T3 during the stress image detection of the display panel greater than the absolute value of the gate-source voltage during the normal display of the display panel, alternatively greater than 2-7 times of the gate-source voltage of the second data writing transistor T3 during the normal display of the display panel, including endpoint values. Finally, the entire stress image detection process is completed.

In the stress image detection process provided by the embodiments of the present disclosure, a specific value of the first high-voltage detection voltage provided by each power signal line is not limited, and is analyzed and designed based on actual applications, as long as the absolute value of the drain-source voltage and the absolute value of the gate-source voltage of the functional transistors can be adjusted higher during the stress image detection (the higher is compared with the normal display of the display panel).

Correspondingly, the present disclosure also provides a display device, and the display device provided by the embodiments of the present disclosure includes the display panel described in any one of the foregoing embodiments.

Figure 16:
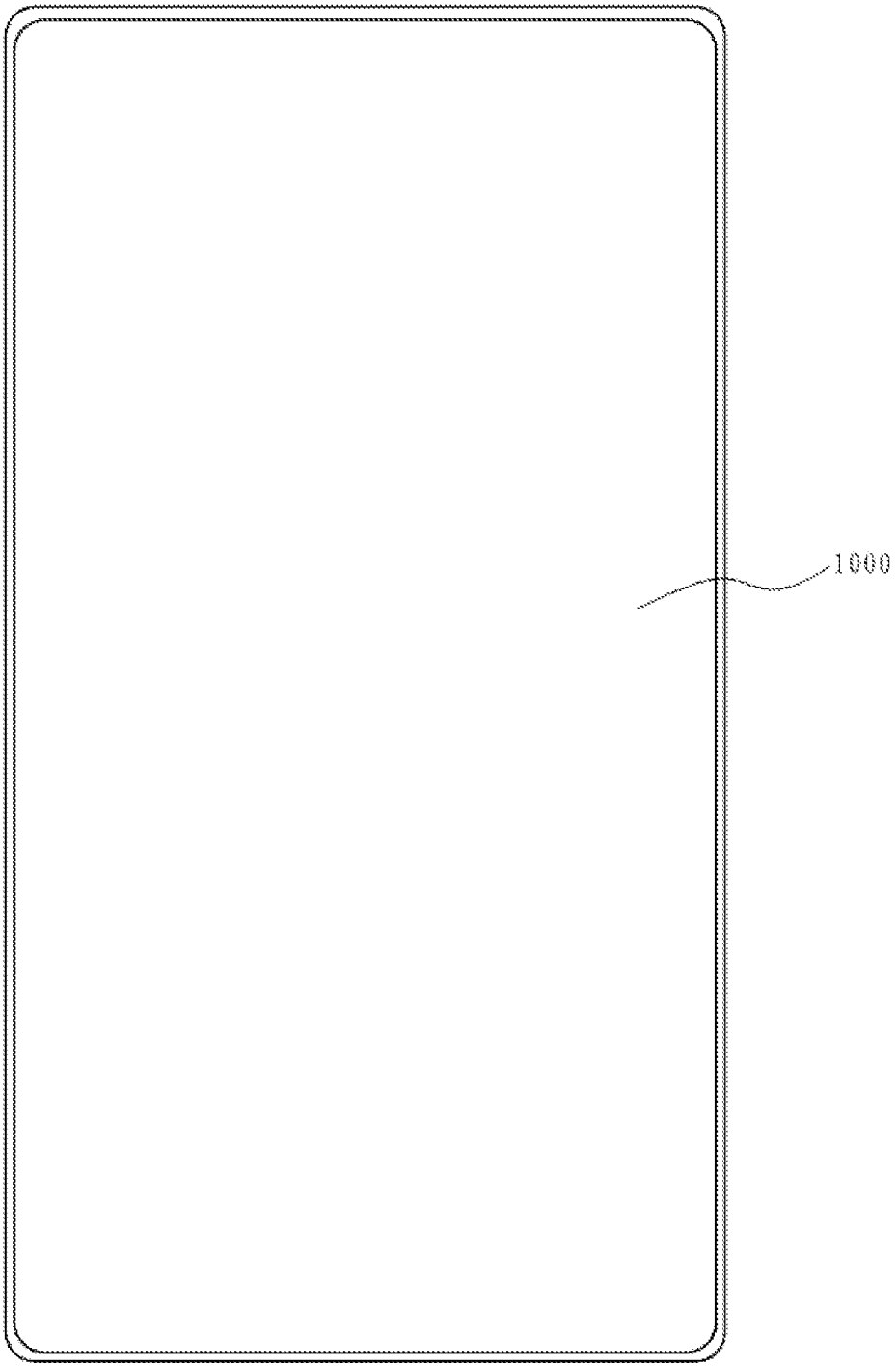
FIG. 16 is a schematic structural diagram of an exemplary display device according to various embodiments of the present disclosure.

Referring to FIG. 16, which is a schematic structural diagram of an exemplary display device according to various embodiments of the present disclosure, the display device provided by the embodiments of the present disclosure may be a mobile terminal 1000, and the mobile terminal includes the display panel provided by any of the foregoing embodiments.

The display device provided by the embodiments of the present disclosure may also be a notebook, a tablet computer, a computer, a wearable device, etc., which is not specifically limited by the present disclosure.

The embodiments of the present disclosure provide the display panel, the method for detecting stress-detection-miss of the display panel, and the display device. The stress-detection-miss detection circuit provided by the embodiments of the present disclosure includes the prompt information path formed in response to the second high-voltage detection voltage during the stress image detection of the display panel, that the prompt information path can generate the prompt information in response to the low-voltage detection voltage. Furthermore, when performing the stress-detection-miss detection on the display panel, whether the display panel has passed the stress image detection can be determined by determining whether the stress-detection-miss detection circuit generates the prompt information based on the low-voltage detection voltage, so as to avoid the occurrence of the stress-detection-miss of the display panel, and to ensure that the display effect of the display panel is high.

The foregoing description of the disclosed embodiments enables those skilled in the art to implement or use the present disclosure. Various modifications to these embodiments will be obvious to those skilled in the art, and the general principles defined in the present disclosure can be implemented in other embodiments without departing from the spirit or scope of the present disclosure. Therefore, the present disclosure will not be limited to the embodiments shown in the present disclosure, but should conform to a widest scope consistent with the principles and novel features disclosed in the present disclosure.

What is claimed is:

1. A display panel, comprising:

a display driving circuit;

a plurality of power signal lines connected to the display driving circuit;

an external stress detection terminal; and a stress-detection-miss detection circuit, wherein:

first access ports of the external stress detection terminal are connected to the plurality of power signal lines in a one-to-one correspondence;

a second access port of the external stress detection terminal is connected to the stress-detection-miss detection circuit;

any one of the plurality of power signal lines is configured to transmit a power supply voltage during normal display of the display panel, and to transmit a first high-voltage detection voltage input from the first access ports during a stress image detection of the display panel, wherein an absolute value of the first high-voltage detection voltage is greater than an absolute value of the power supply voltage; and the stress-detection-miss detection circuit includes: a prompt information path formed in response to a second high-voltage detection voltage input from the second access port during the stress image detection of the display panel, wherein the stress-detection-miss detection circuit is configured to generate prompt information through the prompt information path in response to a low-voltage detection voltage input from the second access port during a stress-detection-miss detection of the display panel, wherein an absolute value of the second high-voltage detection voltage is greater than an absolute value of the low-voltage detection voltage.

2. The display panel according to claim 1, wherein:

the prompt information includes visual prompt information; and the visual prompt information includes lighting information of a light-emitting device.

3. The display panel according to claim 2, wherein:

the stress-detection-miss detection circuit includes a first capacitor and the light-emitting device, a first plate of the first capacitor is connected to the second access port of the external stress detection terminal, and a second plate of the first capacitor is connected to the light-emitting device.

4. The display panel according to claim 2, wherein:

the stress-detection-miss detection circuit includes a second capacitor, a first transistor, and the light-emitting device, a first plate of the second capacitor is connected to the second access port of the external stress detection terminal, a second plate of the second capacitor is connected to a first terminal of the first transistor, a second terminal of the first transistor is connected to the light-emitting device, a gate of the first transistor is connected to a first control signal, and any one of the first access ports of the external stress detection terminal is connected to the second access port.

5. The display panel according to claim 2, wherein:

the stress-detection-miss detection circuit includes a second transistor and the light-emitting device, a first terminal of the second transistor is connected to the second access port of the external stress detection terminal, a second terminal of the second transistor is connected to the light-emitting device, and a gate of the second transistor is connected to a non-enable voltage.

6. The display panel according to claim 5, wherein:

the second transistor is a P-type transistor, the non-enable voltage is a high-level voltage, and the low-voltage detection voltage is a sum of the high-level voltage and a preset voltage.

7. The display panel according to claim 5, wherein:

the second access port of the external stress detection terminal is connected to a port of a driving IC bonding area of the display panel.

8. The display panel according to claim 2, wherein:

the light-emitting device is an organic light-emitting diode.

9. The display panel according to claim 8, wherein:

the display panel includes a display area and a non-display area, the non-display area includes a plurality of dummy pixel units, and the light-emitting device reuses organic light-emitting diodes of the plurality of dummy pixel units.

10. A method for detecting stress-detection-miss of the display panel according to claim 1, comprising:

inputting the low-voltage detection voltage to the second access port of the external stress detection terminal, and in response to a determination that the stress-detection-miss detection circuit does not generate the prompt information based on the low-voltage detection voltage, determining that the display panel has the stress-detection-miss.

11. The method according to claim 10, wherein:

after determining that the display panel has the stress-detection-miss, the stress image detection is performed on the display panel, wherein the display driving circuit includes pixel circuits, the pixel circuits include driving transistors and at least one of functional transistors electrically connected to gates of the driving transistors; and performing the stress image detection on the display panel includes:

providing the first high-voltage detection voltage to the pixel circuits through the plurality of power signal lines;

adjusting a drain-source voltage of all the functional transistors, wherein an absolute value of the drain-source voltage of the functional transistors when the plurality of power signal lines transmits the first high-voltage detection voltage is greater than an absolute value of the drain-source voltage of the functional transistors when the plurality of power signal lines transmits the power supply voltage; and adjusting a gate-source voltage of all the functional transistors, wherein an absolute value of the gate-source voltage of the functional transistors when the plurality of power signal lines transmits the first high-voltage detection voltage is greater than an absolute value of the gate-source voltage of the functional transistors when the plurality of power signal lines transmits the power supply voltage.

12. The method according to claim 10, wherein when the stress-detection-miss detection circuit includes the first capacitor and the light-emitting device, and when the stress-detection-miss detection circuit is connected to the second high-voltage detection voltage, the first capacitor is broken down, and the method includes:

inputting the low-voltage detection voltage to the second access port of the external stress detection terminal, to determine that the light-emitting device does not emit light in response to the low-voltage detection voltage, thereby determining that the display panel has the stress-detection-miss.

13. The method according to claim 10, wherein when the stress-detection-miss detection circuit includes the second capacitor, the first transistor, and the light-emitting device, and when the stress-detection-miss detection circuit is connected to the second high-voltage detection voltage, the second capacitor is broken down, and the method includes:

controlling the first transistor to be turned on; and inputting the power supply voltage transmitted by the plurality of power signal lines to the second access port of the external stress detection terminal through the first access ports connected to the second access port, the power supply voltage being the low-voltage detection voltage, to determine that the light-emitting device does not emit light in response to the low-voltage detection voltage, thereby determining that the display panel has the stress-detection-miss.

14. The method according to claim 10, wherein when the stress-detection-miss detection circuit includes the second transistor and the light-emitting device, and when the stress-detection-miss detection circuit is connected to the second high-voltage detection voltage, a threshold voltage of the second transistor is positively biased, and the method includes:

inputting the low-voltage detection voltage to the second access port of the external stress detection terminal, to determine that the light-emitting device does not emit light in response to the low-voltage detection voltage, thereby determining that the display panel has the stress-detection-miss.

15. The method according to claim 10, wherein when the stress-detection-miss detection circuit includes the second transistor and the light-emitting device, and the second access port of the second external stress detection terminal is connected to the port of the driving IC bonding area of the display panel, and when the stress-detection-miss detection circuit is connected to the second high-voltage detection voltage, the threshold voltage of the second transistor is positively biased, and the method includes:

bonding a driving chip to the driving IC bonding area of the display panel; and controlling the driving chip to input the low-voltage detection voltage to the second access port of the external stress detection terminal, to determine that the light-emitting device does not emit light in response to the low-voltage detection voltage, thereby determining that the display panel has the stress-detection-miss.

16. A display device, comprising:

a display panel, including:

a display driving circuit;

a plurality of power signal lines connected to the display driving circuit;

an external stress detection terminal; and a stress-detection-miss detection circuit, wherein:

first access ports of the external stress detection terminal are connected to the plurality of power signal lines in a one-to-one correspondence;

a second access port of the external stress detection terminal is connected to the stress-detection-miss detection circuit;

any one of the plurality of power signal lines is configured to transmit a power supply voltage during normal display of the display panel, and to transmit a first high-voltage detection voltage input from the first access ports during a stress image detection of the display panel, wherein an absolute value of the first high-voltage detection voltage is greater than an absolute value of the power supply voltage; and the stress-detection-miss detection circuit includes: a prompt information path formed in response to a second high-voltage detection voltage input from the second access port during the stress image detection of the display panel, wherein the stress-detection-miss detection circuit is configured to generate prompt information through the prompt information path in response to a low-voltage detection voltage input from the second access port during a stress-detection-miss detection of the display panel, wherein an absolute value of the second high-voltage detection voltage is greater than an absolute value of the low-voltage detection voltage.

17. The display device according to claim 16, wherein:

the prompt information includes visual prompt information; and the visual prompt information includes lighting information of a light-emitting device.

18. The display device according to claim 17, wherein:

the stress-detection-miss detection circuit includes a first capacitor and the light-emitting device, a first plate of the first capacitor is connected to the second access port of the external stress detection terminal, and a second plate of the first capacitor is connected to the light-emitting device.

19. The display device according to claim 17, wherein:

the stress-detection-miss detection circuit includes a second capacitor, a first transistor, and the light-emitting device, a first plate of the second capacitor is connected to the second access port of the external stress detection terminal, a second plate of the second capacitor is connected to a first terminal of the first transistor, a second terminal of the first transistor is connected to the light-emitting device, a gate of the first transistor is connected to a first control signal, and any one of the first access ports of the external stress detection terminal is connected to the second access port.

20. The display device according to claim 17, wherein:

the stress-detection-miss detection circuit includes a second transistor and the light-emitting device, a first terminal of the second transistor is connected to the second access port of the external stress detection terminal, a second terminal of the second transistor is connected to the light-emitting device, and a gate of the second transistor is connected to a non-enable voltage.

* * * * *